US007909950B2

(12) United States Patent
Kimura et al.

(10) Patent No.: US 7,909,950 B2
(45) Date of Patent: Mar. 22, 2011

(54) METHOD FOR MANUFACTURING AN ULTRA SOFT HIGH CARBON HOT-ROLLED STEEL SHEET

(75) Inventors: Hideyuki Kimura, Hiroshima (JP); Takeshi Fujita, Hiroshima (JP); Nobuyuki Nakamura, Kanagawa (JP); Satoshi Ueoka, Hiroshima (JP); Naoya Aoki, Hiroshima (JP); Kenichi Mitsuzuka, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 499 days.

(21) Appl. No.: 11/919,964

(22) PCT Filed: Sep. 19, 2006

(86) PCT No.: PCT/JP2006/318893

§ 371 (c)(1),
(2), (4) Date: Nov. 6, 2007

(87) PCT Pub. No.: WO2007/043318

PCT Pub. Date: Apr. 19, 2007

(65) Prior Publication Data

US 2009/0065106 A1 Mar. 12, 2009

(30) Foreign Application Priority Data

Oct. 5, 2005 (JP) ..... 2005-292185
Mar. 13, 2006 (JP) ..... 2006-067547
Jul. 27, 2006 (JP) ..... 2006-204083

(51) Int. Cl.
*C21D 8/00* (2006.01)

(52) U.S. Cl. ..... 148/602; 148/659; 148/662; 148/654

(58) Field of Classification Search ..... 148/320, 148/330, 333, 334, 602, 659, 662, 654; 420/104–106, 110, 121, 123, 128
See application file for complete search history.

(56) References Cited

U.S. PATENT DOCUMENTS

2005/0199322 A1 9/2005 Nakamura et al.

FOREIGN PATENT DOCUMENTS

| | | | |
|---|---|---|---|
| EP | 2 000 552 | A2 | 12/2008 |
| EP | 2 000 552 | A9 | 12/2008 |
| JP | 64-025946 | A | 1/1989 |
| JP | 08-246051 | A | 9/1996 |
| JP | 09-157758 | A | 6/1997 |
| JP | 11-080884 | A | 3/1999 |
| JP | 11-256268 | A | 9/1999 |
| JP | 2001-220642 | A | 8/2001 |
| JP | 2003-073742 | A | 3/2003 |

OTHER PUBLICATIONS

Machine-English translation of Japnaese patent 2003-013145, Fujita Takeshi et al., Jan. 15, 2003.*
English abstract of Japanese patent 2005-131660, Makoto Suzuki et al., May 26, 2005.*

* cited by examiner

*Primary Examiner* — Deborah Yee
(74) *Attorney, Agent, or Firm* — Holtz, Holtz, Goodman & Chick, P.C.

(57) ABSTRACT

The present invention provides an ultra soft high carbon hot-rolled steel sheet. The ultra soft high carbon hot-rolled steel sheet contains 0.2% to 0.7% of C, 0.01% to 1.0% of Si, 0.1% to 1.0% of Mn, 0.03% or less of P, 0.035% or less of S, 0.08% or less of Al, 0.01% or less of N, and the balance being Fe and incidental impurities and further contains 0.0010% to 0.0050% of B and 0.05% to 0.30% of Cr in some cases. In the texture of the steel sheet, an average ferrite grain diameter is 20 μm or more, a volume ratio of ferrite grains having a grain diameter of 10 μm or more is 80% or more, and an average carbide grain diameter is in the range of 0.10 to less than 2.0 μm. In addition, the steel sheet is manufactured by the steps, after rough rolling, performing finish rolling at a reduction ratio of 10% or more and at a finish temperature of ($Ar_3$−20° C.) or more in a final pass, then performing first cooling within 2 seconds after the finish rolling to a cooling stop temperature of 600° C. or less at a cooling rate of more than 120° C./sec, then performing second cooling so that the steel thus processed is held at 600° C. or less, then performing coiling at 580° C. or less, followed by pickling, and then performing spheroidizing annealing at a temperature in the range of 680° C. to the $Ac_1$ transformation point.

4 Claims, No Drawings

METHOD FOR MANUFACTURING AN ULTRA SOFT HIGH CARBON HOT-ROLLED STEEL SHEET

This application is the United States national phase application of International Application PCT/JP2006/318893 filed Sep. 19, 2006.

TECHNICAL FIELD

The present invention relates to an ultra soft high carbon hot-rolled steel sheet and a manufacturing method thereof.

BACKGROUND ART

High carbon steel sheets used, for example, for tools and automobile parts (gears and transmissions) are processed by heat treatment such as quenching and tempering after punching and/or molding. In recent years, in manufactures of tools and parts, that is, in customers of high carbon steel sheets, in order to reduce the cost, instead of part fabrication by cutting and hot forging of casting materials which has been performed in the past, simplification of fabrication steps has been studied by press molding (including cold forging) of steel sheets. Concomitant with this study, besides excellent quenching performance, a high carbon steel sheet as a raw material has been desired to have good workability so that a complicated shape is formed by a small number of steps and, in particular, has been strongly desired to have soft properties. In addition, in view of load decrease of pressing machines and metal molds, the soft properties are also strongly anticipated.

In consideration of the current situations, as for softening of a high carbon steel sheet, various techniques have been studied. For example, in Patent Document 1, a method for manufacturing a high carbon steel strip has been proposed in which after hot rolling, a steel strip is heated to a ferrite-austenite two phase region, followed by annealing at a predetermined cooling rate. According to this technique, a high carbon steel strip is annealed at the $Ac_1$ point or more in the ferrite-austenite two phase region, so that a texture is formed in which rough large spheroidizing cementite is uniformly distributed in a ferrite matrix. In particular, after high carbon steel containing 0.2% to 0.8% of C, 0.03% to 0.30% of Si, 0.20% to 1.50% of Mn, 0.01% to 0.10% of sol. Al, and 0.0020% to 0.0100% of N, and having a ratio of the sol. Al to N of 5 to 10, is processed by hot rolling, pickling, and descaling, annealing is performed at a temperature range of 680° C. or more, a heating rate Tv (° C./Hr) in the range of 500×(0.01−N(%) as AlN) to 2,000×(0.1−N(%) as AlN), and a soaking temperature TA (° C.) in the range of the $Ac_1$ point to $222\times C(\%)^2-411\times C(\%)+912$ for a soaking heating time of 1 to 20 hours in a furnace containing not less than 95 percent by volume of hydrogen and nitrogen as the balance, followed by cooling to room temperature at a cooling rate of 100° C./Hr or less.

For example, in Patent Document 2, a manufacturing method has been disclosed in which a hot-rolled steel sheet containing 0.1 to 0.8 mass percent of carbon and 0.01 mass percent or less of sulfur is sequentially processed by a first heating step at a temperature range of $Ac_1-50°$ C. to less than $Ac_1$ for a hold time of 0.5 hours or more, a second heating step at a temperature range of $Ac_1$ to $Ac_1+100°$ C. for a hold time of 0.5 to 20 hours, and a third heating step at a temperature range of $Ar_1-50°$ C. to $Ar_1$ for a hold time of 2 to 20 hours, and in which the cooling rate from the hold temperature in the second step to that in the third step is set to 5 to 30° C./Hr. By performing the three-stage annealing as described above, it is attempted to obtain a high carbon steel sheet having an average ferrite grain diameter of 20 μm or more.

In addition, in Patent Documents 3 and 4, a method has been disclosed in which carbon contained in steel is graphitized so as to obtain softened steel having high ductility.

Furthermore, in Patent Document 5, a method for uniformly forming rough large ferrite grains to obtain ultra soft steel has been disclosed in which steel containing 0.2 to 0.7 mass percent of carbon is hot-rolled to control the texture so as to have more than 70 percent by volume of bainite, followed by annealing. According to this technique, after finish rolling is performed at a temperature of (the $Ar_3$ transformation point−20° C.) or more, cooling is performed to a cooling stop temperature of 550° C. or less at a cooling rate of more than 120° C./sec, and after coiling at a temperature of 500° C. or less and pickling are performed, annealing is performed at a temperature in the range of from 640° C. to the $Ac_1$ transformation point.

Patent Document 1: Japanese Unexamined Patent Application Publication No. 9-157758

Patent Document 2: Japanese Unexamined Patent Application Publication No. 11-80884

Patent Document 3: Japanese Unexamined Patent Application Publication No. 64-25946

Patent Document 4: Japanese Unexamined Patent Application Publication No. 8-246051

Patent Document 5: Japanese Unexamined Patent Application Publication No. 2003-73742

DISCLOSURE OF INVENTION

However, the above techniques have the following problems.

According to the technique disclosed in Patent Document 1, a high carbon steel strip is annealed in the ferrite-austenite two phase region at a temperature of the $Ac_1$ point or more so as to form rough large spheroidizing cementite; however, since the rough large cementite described above has a slow dissolution rate, it is apparent that the quenching properties are degraded. In addition, the hardness Hv of a S35C material after annealing is 132 to 141 (HBR 72 to 75), and this material may not be exactly regarded as a soft material.

As for the technique disclosed in Patent Document 2, since the annealing step is complicated, when the operation is actually performed, the productivity is degraded, and as a result, the cost is increased.

According to the techniques disclosed in Patent Documents 3 and 4, the carbon in steel is graphitized, and since the dissolution rate of graphite is slow, the quenching properties are disadvantageously degraded.

Furthermore, according to the technique disclosed in Patent Document 5, since rough large ferrite grains are formed by spheroidizing annealing of a hot-rolled steel sheet having more than 70 percent by volume of bainite, an ultra soft steel sheet can be obtained; however, since after hot rolling is performed at a finish temperature of (the $Ar_3$ transformation point−20° C.) or more, since rapid cooling is performed at a cooling rate of more than 120° C./sec, the temperature is increased by transformation heat generation after cooling, and as a result, the stability of the hot-rolled steel sheet texture is disadvantageously degraded. In addition, the hardness after the spheroidizing annealing is only evaluated on the sheet surface of the sample by Rockwell B scale hardness (HRB), and since the rough large ferrite grains are not uniformly formed in the thickness direction after the spheroidizing annealing, and the material properties are liable to vary, a stably softened steel sheet cannot be obtained.

The present invention was made in consideration of the situations described above, and an object of the present invention is to provide an ultra soft high carbon hot-rolled steel sheet which can be manufactured without performing high temperature annealing in the ferrite-austenite region and without using multi-stage annealing and which is not likely to be cracked in press molding and cold forging.

Intensive research was carried out by the inventors of the present invention about the composition, micro-texture, and manufacturing conditions which influence on the hardness of a high carbon steel sheet while the quenching properties are maintained. As a result, it was found that as the factors having significant influences on the hardness of a steel sheet, besides the composition of steel and the shape and volume of carbide, there are mentioned an average carbide grain diameter, an average ferrite grain diameter, and a rough large ferrite ratio (the volume ratio of ferrite grains having a grain diameter not less than a predetermined value). In addition, it was also found that when the average carbide grain diameter, the average ferrite grain diameter, and the rough large ferrite ratio are each controlled in an appropriate range, the hardness of a high carbon steel sheet is remarkably decreased while the quenching properties thereof are maintained.

Furthermore, in the present invention, based on the above findings, the manufacturing method was investigated to control the above texture, and as a result, a method for manufacturing an ultra soft high carbon hot-rolled steel sheet was established.

The present invention was made based on the above findings, and the aspects thereof are as follows.

[1] An ultra soft high carbon hot-rolled steel sheet is provided which comprises on a mass percent basis: 0.2% to 0.7% of C, 0.01% to 1.0% of Si, 0.1% to 1.0% of Mn, 0.03% or less of P, 0.035% or less of S, 0.08% or less of Al, 0.01% or less of N, and the balance being Fe and incidental impurities, wherein in the texture of the hot-rolled steel sheet, an average ferrite grain diameter is 20 μm or more, a volume ratio of ferrite grains having a grain diameter of 10 μm or more is 80% or more, and an average carbide grain diameter is in the range of 0.10 to less than 2.0 μm.

[2] An ultra soft high carbon hot-rolled steel sheet is provided which comprises on a mass percent basis: 0.2% to 0.7% of C, 0.01% to 1.0% of Si, 0.1% to 1.0% of Mn, 0.03% or less of P, 0.035% or less of S, 0.08% or less of Al, 0.01% or less of N, and the balance being Fe and incidental impurities, wherein in the texture of the hot-rolled steel sheet, an average ferrite grain diameter is more than 35 μm, a volume ratio of ferrite grains having a grain diameter of 20 μm or more is 80% or more, and an average carbide grain diameter is in the range of 0.10 to less than 2.0 μm.

[3] In the above [1] or [2], the ultra soft high carbon hot-rolled steel sheet may further comprise at least one of 0.0010% to 0.0050% of B and 0.005% to 0.30% of Cr on a mass percent basis.

[4] In the above [1] and [2], the ultra soft high carbon hot-rolled steel sheet may further comprise 0.0010% to 0.0050% of B and 0.05% to 0.30% of Cr on a mass percent basis.

[5] In one of the above [1] to [4], the ultra soft high carbon hot-rolled steel sheet may further comprise at least one of 0.005% to 0.5% of Mo, 0.005% to 0.05% of Ti, and 0.005% to 0.1% of Nb on a mass percent basis.

[6] A method for manufacturing an ultra soft high carbon hot-rolled steel sheet is provided which comprises the steps of: performing rough rolling of steel having the composition according to one of the above [1], [3], [4], and [5], then performing finish rolling at a reduction ratio of 10% or more and at a finish temperature of $(Ar_3-20)$° C. or more in a final pass, then performing first cooling within 2 seconds after the finish rolling to a cooling stop temperature of 600° C. or less at a cooling rate of more than 120° C./sec, then performing second cooling so that the steel thus processed is held at 600° C. or less, then performing coiling at 580° C. or less, followed by pickling, and then performing spheroidizing annealing at a temperature in the range of 680° C. to the $Ac_1$ transformation point by a box-annealing process.

[7] A method for manufacturing an ultra soft high carbon hot-rolled steel sheet is provided which comprises the steps of: performing rough rolling of steel having the composition according to one of the above [1], [3], [4], and [5], then performing finish rolling at a reduction ratio of 10% or more and at a finish temperature of $(Ar_3-20)$° C. or more in a final pass, then performing first cooling within 2 seconds after the finish rolling to a cooling stop temperature of 550° C. or less at a cooling rate of more than 120° C./sec, then performing second cooling so that the steel thus processed is held at 550° C. or less, then performing coiling at 530° C. or less, followed by pickling, and then performing spheroidizing annealing at a temperature in the range of 680° C. to the $Ac_1$ transformation point by a box-annealing process.

[8] A method for manufacturing an ultra soft high carbon hot-rolled steel sheet is provided which comprises the steps of: performing rough rolling of steel having the composition according to one of the above [2] to [5], then performing finish rolling in which final two passes are each performed at a reduction ratio of 10% or more in a temperature range of $(Ar_3-20)$° C. to $(Ar_3+150)$° C., then performing first cooling within 2 seconds after the finish rolling to a cooling stop temperature of 600° C. or less at a cooling rate of more than 120° C./sec, then performing second cooling so that the steel is held at 600° C. or less, then performing coiling at 580° C. or less, followed by pickling, and then performing spheroidizing annealing at a temperature in the range of 680° C. to the $Ac_1$ transformation point for a soaking time of 20 hours or more by a box-annealing process.

[9] A method for manufacturing an ultra soft high carbon hot-rolled steel sheet is provided which comprises the steps of: performing rough rolling of steel having the composition according to one of the above [2] to [5], then performing finish rolling in which final two passes are each performed at a reduction ratio of 10% or more in a temperature range of $(Ar_3-20)$° C. to $(Ar_3+100)$° C., then performing first cooling within 2 seconds after the finish rolling to a cooling stop temperature of 550° C. or less at a cooling rate of more than 120° C./sec, then performing second cooling so that the steel is held at 550° C. or less, then performing coiling at 530° C. or less, followed by pickling, and then performing spheroidizing annealing at a temperature in the range of 680° C. to the $Ac_1$ transformation point for a soaking time of 20 hours or more by a box-annealing process.

In this specification, the percents of the components of steel are all mass percents.

According to the present invention, while the quenching properties are maintained, an ultra soft high carbon hot-rolled steel sheet can be obtained.

In addition, besides the spheroidizing annealing conditions after hot rolling, the ultra soft high carbon hot-rolled steel sheet of the present invention can be manufactured by controlling the hot-rolled steel sheet texture before annealing, that is, by controlling hot-rolling conditions, and can be manufactured without performing high temperature annealing in the ferrite-austenite region and without using multi-stage annealing. As a result, since an ultra soft high carbon hot-rolled steel sheet having superior workability is used, the working process can be simplified, and as a result, the cost can be reduced.

BEST MODE FOR CARRYING OUT THE INVENTION

An ultra soft high carbon hot-rolled steel sheet according to the present invention is controlled to have a composition shown below and has a texture in which the average ferrite grain diameter is 20 μm or more, the volume ratio (hereinafter referred to as a "rough large ferrite ratio (grain diameter of 10 μm or more") of ferrite grains having a grain diameter of 10 μm or more is 80% or more, and the average carbide grain diameter is 0.10 to less than 2.0 μm. In more preferable, the average ferrite grain diameter is more than 35 μm, the volume ratio (hereinafter referred to as a "rough large ferrite ratio (grain diameter of 20 μm or more") of ferrite grains having a grain diameter of 20 μm or more is 80% or more, and the average carbide grain diameter is 0.10 to less than 2.0 μm. Those described above are most important in the present invention. When the composition, the metal texture (average ferrite grain diameter and the rough large ferrite ratio), and the carbide shape (average carbide grain diameter) are defined as described above and are all satisfied, an ultra soft high carbon hot-rolled steel sheet can be obtained while the quenching properties are maintained.

In addition, the ultra soft high carbon hot-rolled steel sheet described above is manufactured by the steps of performing rough rolling of steel having a composition described below, then performing finish rolling at a reduction ratio of 10% or more and at a finish temperature of ($Ar_3$−20° C.) or more in a final pass, then performing first cooling within 2 seconds after the finish rolling to a cooling stop temperature of 600° C. or less at a cooling rate of more than 120° C./sec, then performing second cooling so that the steel thus processed is held at 600° C. or less, then performing coiling at 580° C. or less, followed by pickling, and then performing spheroidizing annealing at a temperature in the range of 680° C. to the $Ac_1$ transformation point by a box-annealing process.

Furthermore, an ultra soft high carbon hot-rolled steel sheet having the preferable texture described above can be manufactured by the steps of performing rough rolling of steel having a composition described below, then performing finish rolling in which final two passes are each performed at a reduction ratio of 10% or more (preferably 13% or more) in a temperature range of ($Ar_3$−20° C.) to ($Ar_3$+150° C.), then performing first cooling within 2 seconds after the finish rolling to a cooling stop temperature of 600° C. or less at a cooling rate of more than 120° C./sec, then performing second cooling so that the steel thus processed is held at 600° C. or less, then performing coiling at 580° C. or less, followed by pickling, and then performing spheroidizing annealing at a temperature in the range of 680° C. to the $Ac_1$ transformation point for a soaking time of 20 hours or more by a box-annealing process.

When the manufacturing conditions including the hot finish rolling, first cooling, second cooling, coiling, and annealing are totally controlled as described above, an object of the present invention can be achieved.

Heretofore, the present invention will be described in detail.

First, the reasons chemical components of steel of the present invention are determined will be described.

(1) C: 0.2% to 0.7%

C is a most basic alloying element of carbon steel. Depending on the C content, a quenched hardness and the amount of carbide in an annealed state are considerably changed. In steel having a C content of less than 0.2%, formation of proeutectoid ferrite apparently occurs in a texture after hot rolling, and a stable rough large ferrite grain texture cannot be obtained after annealing, so that stable softening cannot be achieved. In addition, a sufficient quenched hardness required, for example, for automobile parts cannot be obtained. On the other hand, when the C content is more than 0.7%, the toughness after hot rolling is degraded besides degradation in productionability and handling properties of steel strips, and this type of steel is difficult to be used for a part that requires a material to have a high degree of workability. Hence, in order to provide a steel sheet having both adequate quenched hardness and workability, the C content is set to 0.2% to 0.7% and is preferably set to 0.2% to 0.5%.

(2) Si: 0.01% to 1.0%

Si is an element improving the quenching properties. When the Si content is less than 0.01%, the hardness in quenching is insufficient. On the other hand, when the Si content is more than 1.0%, because of solid-solution strengthening, ferrite is hardened, and as a result, the workability is degraded. Furthermore, carbide is graphitized, and the quenching properties tend to be degraded. Hence, in order to provide a steel sheet having both adequate quenched hardness and workability, the Si content is set to 0.01% to 1.0% and is preferably set to 0.01% to 0.8%.

(3) Mn: 0.1% to 1.0%

Mn is an element improving the quenching properties as a Si element. In addition, Mn is an important element since S is fixed in the form of MnS, and hot cracking of a slab is prevented. When the Mn content is less than 0.1%, the above effect cannot be sufficiently obtained, and in addition, the quenching properties are seriously degraded. On the other hand, when the Mn content is more than 1.0%, because of solid-solution strengthening, ferrite is hardened, and as a result, the workability is degraded. Hence, in order to provide a steel sheet having both adequate quenched hardness and workability, the Mn content is set to 0.1% to 1.0% and is preferably set to 0.1% to 0.8%.

(4) P: 0.03% or Less

Since P segregates in grain boundaries, and the ductility and the toughness are degraded, the P content is set to 0.03% or less and is preferably set to 0.02% or less.

(5) S: 0.035% or Less

S forms MnS with Mn and degrades the workability and the toughness after quenching; hence, S is an element that should be decreased, and the content thereof is preferably decreased as small as possible. However, since an S content of up to 0.035% is permissible, the S content is set to 0.035% or less and is preferably set to 0.03% or less.

(6) Al: 0.08% or Less

When Al is excessively added, a large amount of AlN is precipitated, and as a result, the quenching properties are degraded; hence, the Al content is set to 0.08% or less and is preferably set to 0.06% or less.

(7) N: 0.01% or Less

When N is excessively contained, the ductility is degraded; hence, the N content is set to 0.01% or less.

By the above addition elements, the steel according to the present invention can obtain target properties; however, besides the above addition elements, at least one of B and Cr may also be added. When the above elements are added, preferable contents thereof are shown below, and although one of B and Cr may be added, two elements, B and Cr, are preferably added.

(8) B: 0.0010% to 0.0050% B is an important element which suppresses the formation of proeutectoid ferrite in cooling after hot rolling and which forms uniform rough large ferrite grains after annealing. However, when the B content is less than 0.0010%, a sufficient effect may not be obtained in some cases. On the other hand, when the B content is more than 0.0050%, the effect is saturated, and in addition, the load in hot rolling is increased, so that the operationability may be degraded in some cases. Accordingly, when B is added, the B content is preferably set to 0.0010% to 0.0050%.

(9) Cr: 0.005% to 0.30%

Cr is an important element which suppresses the formation of proeutectoid ferrite in cooling after hot rolling and which forms uniform rough large ferrite grains after annealing. However, when the Cr content is less than 0.005%, a sufficient effect may not be obtained in some cases. On the other hand, when the Cr content is more than 0.30%, the effect of suppressing the formation of proeutectoid ferrite is saturated, and in addition, the cost is increased. Accordingly, when Cr is added, the Cr content is preferably set to 0.005% to 0.30%. More preferably, the Cr content is set to 0.05% to 0.30%.

In addition, in order to more efficiently obtain the effect of suppressing the formation of proeutectoid ferrite, it is preferable that B and Cr be simultaneously added, and in this case, it is more preferable that the B content be set to 0.0010% to 0.0050% and that the Cr content be set to 0.05% to 0.30%.

In addition, in order to further efficiently suppress the formation of proeutectoid ferrite and improve the quenching properties, at least one of Mo, Ti, and Nb may be added whenever necessary. In this case, when the contents of Mo, Ti, and Nb are each less than 0.005%, the effect of the addition cannot be sufficiently obtained. On the other hand, when the contents of Mo, Ti, and Nb are more than 0.5%, more than 0.05%, and more than 0.1%, respectively, the effect is saturated, the cost is increased, and the increase in strength is further significant, for example, by solid-solution strengthening and precipitation strengthening, so that the workability is degraded. Accordingly, when at least one of Mo, Ti, and Nb is added, the Mo content, the Ti content, and the Nb content are set to 0.005% to 0.5%, 0.005% to 0.05%, and 0.005% to 0.1%, respectively.

The balance other than the elements described above includes Fe and incidental impurities. As the incidental impurities, for example, O forms a non-metal interstitial material and has an adverse influence on the quality, and hence the O content is preferably decreased to 0.003% or less. In addition, as trace elements having no adverse influences on the effects of the present invention, Cu, Ni, W, V, Zr, Sn, and Sb in an amount of 0.1% or less may be contained.

Next, the texture of the ultra soft high carbon hot-rolled steel sheet of the present invention will be described.

(1) Average Ferrite Grain Diameter: 20 μm or More

The average ferrite grain diameter is an important factor responsible for determining the hardness, and when ferrite grains are made rough and large, the softening can be achieved. That is, when the average ferrite grain diameter is set to 20 μm or more, ultra softness can be obtained, and superior workability can also be obtained. In addition, when the average ferrite grain diameter is set to more than 35 μp, the ultra softness can be further improved, and more superior workability can be obtained. Accordingly, the average ferrite grain diameter is set to 20 μm or more, preferably more than 35 μm, and more preferably 50 μm or more.

(2) Rough Large Ferrite Ratio (Volume Ratio of Ferrite Grains Having a Grain Diameter of 10 μm or More or a Grain Diameter of 20 μm or More): 80% or More The softness is improved as the ferrite grains are made rougher and larger; however, in order to stabilize the softening, it is preferable that the ratio of ferrite grains having a diameter not less than a predetermined value be high. Hence, the volume ratio of ferrite grains having a grain diameter of 10 μm or more or a grain diameter of 20 μm or more is defined as a rough large ferrite ratio, and in the present invention, this rough large ferrite ratio is set to 80% or more.

When the rough large ferrite ratio is less than 80%, since a mixed grain texture is formed, stable softening cannot be performed. Hence, in order to achieve stable softening, the rough large ferrite ratio is set to 80% or more and is preferably set to 85% or more. In addition, in terms of softening, the ferrite grains are preferably rough and large, and hence the rough large ferrite ratio having a grain diameter of 10 μm or more or preferably having 20 μm or more is set to 80% or more.

In addition, when the ratio of an area of rough large ferrite grains having a grain diameter not less than a predetermined value to an area of ferrite grains having a grain diameter less than the predetermined value is obtained and is then regarded as the volume ratio, the rough large ferrite ratio can be obtained, and in this case, the areas described above can be obtained from the cross-section of a steel sheet by metal texture observation (using at least 10 visual fields at a magnification of approximately 200 times).

In addition, as described later, a steel sheet having rough large ferrite grains and a rough large ferrite ratio of 80% or more can be obtained when the reduction ratio and the temperature in finish rolling are controlled as described below. In particular, a steel sheet having an average ferrite grain diameter of 20 μm or more and a rough large ferrite ratio (grain diameter of 10 μm or more) of 80% or more can be obtained when finish rolling is performed at a final pass reduction ratio of 10% or more and a temperature of $(Ar_3-20)°$ C. or more. When the reduction ratio in the final pass is set to 10% or more, a grain-growth driving force is increased, and the ferrite grains are uniformly grown rough and large. In addition, a steel sheet having an average ferrite grain diameter of more than 35 μm and a rough large ferrite ratio (grain diameter of 20 μm or more) of 80% or more can be obtained by finish rolling in which final two passes are each performed at a reduction ratio of 10% or more (preferably in the range of 13% to less than 40%) and a temperature in the range of $(Ar_3-20)°$ C. to $(Ar_3+150)°$ C. (preferably in the range of $(Ar_3-20)°$ C. to $(Ar_3+100)°$ C.). When the reduction ratios of the final two passes are each set to 10% or less (preferably in the range of 13% to less than 40%), many shear zones are formed in old austenite grains, and the number of nucleation sites of transformation is increased. As a result, lath-shaped ferrite grains forming a bainite texture becomes fine, and by using very high grain boundary energy as a driving force, the ferrite grains are uniformly grown rough and large.

(3) Average Carbide Grain Diameter: 0.10 μm to Less than 2.0 μm

The average carbide grain diameter is an important factor since it has significant influences on general workability, punching machinability, and quenched strength in annealing after processing. When carbide becomes fine, it is likely to be dissolved at an annealing stage after processing, and as a result, stable quenched hardness can be ensured; however, when the average carbide grain diameter is less than 0.10 μm, the workability is degraded as the hardness is increased. On the other hand, although the workability is improved as the average carbide grain diameter is increased, when the average carbide grain diameter is 2.0 μm or more, carbide is not likely to be dissolved, and the quenched strength is decreased. Accordingly, the average carbide grain diameter is set to 0.10 to less than 2.0 μm. In addition, as described later, the average carbide grain diameter can be controlled by manufacturing conditions, and in particular, by a first cooling stop temperature after hot rolling, a second cooling hold temperature, a coiling temperature, and annealing conditions.

Next, a method for manufacturing the ultra soft high carbon hot-rolled steel sheet of the present invention will be described.

The ultra soft high carbon hot-rolled steel sheet of the present invention can be obtained by a process comprising the steps of performing rough rolling of steel which is controlled to have the above chemical component composition, then performing finish rolling at a desired reduction ratio and temperature, then performing cooling under desired cooling conditions, followed by coiling and pickling, and then performing desired spheroidizing annealing by a box annealing method. The steps mentioned above will be described below in detail.

(1) Reduction Ratio and Temperature (Rolling Temperature) in Finish Rolling When the final pass reduction ratio is set to 10% or more, many shear zones are formed in old austenite grains, and the number of nucleation sites of transformation is increased. Hence, lath-shaped ferrite grains forming bainite become fine, and by using high grain boundary energy as a driving force in spheroidizing annealing, a uniform rough large ferrite grain texture is obtained having an average ferrite grain diameter of 20 μm or more and a rough large ferrite ratio (a grain diameter of 10 μm or more) of 80% or more. On the other hand, when the final pass reduction ratio is less than 10%, since the lath-shaped ferrite grains become rough and large, the grain growth driving force is deficient, and a ferrite grain texture having an average ferrite grain diameter of 20 μm or more and a rough large ferrite ratio (a grain diameter of 10 μm or more) of 80% or more cannot be obtained after annealing, so that stable softening cannot be achieved. By the reasons described above, the final pass reduction ratio is set to 10% or more, and in consideration of uniform formation of rough large grains, it is preferably set to 13% or more and is more preferably set to 18% or more. On the other hand, when the final pass reduction ratio is 40% or more, the load in rolling is increased, and hence the upper limit of the final pass reduction ratio is preferably set to less than 40%.

When the finish temperature (rolling temperature in the final pass) in hot rolling of steel is less than $(Ar_3-20)$° C., since the ferrite transformation partly proceeds, and the number of proeutectoid ferrite grains is increased, a mixed-grain ferrite texture is formed after spheroidizing annealing, and a ferrite grain texture having an average ferrite grain diameter of 20 μm or more and a rough large ferrite ratio (a grain diameter of 10 μm or more) of 80% or more cannot be obtained, so that stable softening cannot be achieved. Hence, the finish temperature is set to $(Ar_3-20)$° C. or more. Accordingly, in the final pass, the reduction ratio is set to 10% or more, and the finish temperature is set to $(Ar_3-20)$° C. or more.

Furthermore, in addition to the reduction ratio in the final pass, when the reduction ratio in a pass prior to the final pass is set to 10% or more, because of a strain accumulation effect, many shear zones are formed in old austenite grains, and the number of nucleation sites of transformation is increased. Hence, lath-shaped ferrite grains forming bainite become fine, and by using high grain boundary energy as a driving force in spheroidizing annealing, a uniform rough large ferrite grain texture is obtained having an average ferrite grain diameter of more than 35 μm and a rough large ferrite ratio (a grain diameter of 20 μm or more) of 80% or more. On the other hand, when the reduction ratio of the final pass and that of the pass prior thereto are less than 10%, since the lath-shaped ferrite grains become rough and large, the grain growth driving force is deficient, and a ferrite grain texture having an average ferrite grain diameter of more than 35 μm and a rough large ferrite ratio (a grain diameter of 20 μm or more) of 80% or more cannot be obtained after annealing, so that stable softening cannot be achieved. By the reasons described above, the reduction ratios of the final two passes are each preferably set to 10% or more, and in order to more uniformly form rough large grains, the reduction ratios of the final two passes are each preferably set to 13% or more and are more preferably set to 18% or more. On the other hand, when the reduction ratios of the final two passes are 40% or more, the load in rolling is increased, and hence the upper limit of the reduction ratios of the final two passes are each preferably set to less than 40%.

In addition, when the finish temperatures of the final two passes are each performed in a temperature range of $(Ar_3-20)$° C. to $(Ar_3+150)$° C., the strain accumulation effect is maximized, and hence a uniform rough large ferrite grain texture can be obtained in spheroidizing annealing which has an average ferrite grain diameter of more than 35 μm and a rough large ferrite ratio (a grain diameter of 20 μm or more) of 80% or more. When the finish temperatures of the final two passes are less than $(Ar_3-20)$° C., since the ferrite transformation partly proceeds, and the number of proeutectoid ferrite grains is increased, a mixed-grain ferrite texture is formed after spheroidizing annealing, and as a result, a ferrite grain texture having an average ferrite grain diameter of more than 35 μm and a rough large ferrite ratio (a grain diameter of 20 μm or more) of 80% or more cannot be obtained after annealing, so that more stable softening cannot be achieved. On the other hand, when the rolling temperatures of the final two passes exceed $(Ar_3+150)$° C., the strain accumulation effect becomes deficient due to strain recovery, and as a result, a ferrite grain texture having an average ferrite grain diameter of more than 35 μm and a rough large ferrite ratio (a grain diameter of 20 μm or more) of 80% or more cannot be obtained after annealing, so that more stable softening may not be achieved in some cases. By the reasons described above, the rolling temperature ranges of the final two passes are each preferably set in the range of $(Ar_3-20)$° C. to $(Ar_3+150)$° C. and is more preferably set in the range of $(Ar_3-20)$° C. to $(Ar_3+100)$° C.

Accordingly, in finish rolling, the reduction ratios of the final two passes are each preferably set to 10% or more and more preferably set to 13% or more, and the temperature is preferably set in the range of $(Ar_3-20)$° C. to $(Ar_3+150)$° C. and more preferably in the range of $(Ar_3-20)$° C. to $(Ar_3+100)$° C.

Incidentally, the $Ar_3$ transformation point (° C.) can be calculated by the following equation (1).

$$Ar_3=910-310C-80Mn-15Cr-80Mo \quad (1)$$

In this equation, the chemical symbols each indicate the content (mass percent) thereof.

(2) First Cooling Rate: Cooling at a rate of more than 120° C./sec performed within 2 seconds after finish rolling When the first cooling method after hot rolling is slow cooling, the degree of undercooling of austenite is small, and many proeutectoid ferrite grains are generated. When the cooling rate is 120° C./sec or less, the formation of proeutectoid ferrite apparently occurs, carbide is non-uniformly dispersed after annealing, and a stable rough large ferrite grain texture cannot be obtained, so that softening cannot be achieved. Hence, the cooling rate of the first cooling after hot rolling is set to more than 120° C./sec. The cooling rate is preferably set to 200° C./sec or more and is more preferably set to 300° C./sec or more. The upper limit of the cooling rate is not particularly limited; however, for example, when the sheet thickness is assumed to be 3.0 mm, in consideration of capacity determined by the present facilities, the upper limit is 700° C./sec. In addition, when the time from the finish rolling to the start of cooling is more than 2 seconds, since austenite grains are recrystallized, the strain accumulation effect cannot be obtained, and the grain growth driving force is deficient. Hence, a stable rough large ferrite grain texture cannot be obtained after annealing, and as a result, softening cannot be achieved. Accordingly, the time from the finish rolling to the start of cooling is set to 2 seconds or less. In addition, in order to suppress recrystallization of austenite grains and to stably ensure the strain accumulation effect and a high grain growth driving force in annealing, the time from the finish rolling to the start of cooling is preferably set to 1.5 seconds or less and more preferably set to 1.0 second or less.

(3) First Cooling Stop Temperature: 600° C. or Less

When the first cooling stop temperature after hot rolling is more than 600° C., many proeutectoid ferrite grains are generated. Hence, carbide is non-uniformly dispersed after annealing, and a stable rough large ferrite grain texture cannot be obtained, so that softening cannot be achieved. Accordingly, in order to stably obtain a bainite texture after hot rolling, the first cooling stop temperature after hot rolling is set to 600° C. or less, preferably 580° C. or less, and more preferably 550° C. or less. The lower temperature limit is not particularly limited; however, the sheet shape is deteriorated as the temperature is decreased, the lower temperature limit is preferably set to 300° C. or more.

(4) Second Cooling Hold Temperature: 600° C. or Less

In the case of a high carbon steel sheet, after first cooling, concomitant with proeutectoid ferrite transformation, pearlite transformation, and bainite transformation, the steel sheet temperature may be increased in some cases, and even if the first cooling stop temperature is 600° C. or less, when the temperature is increased from the end of the first cooling to coiling, proeutectoid ferrite is generated. Hence, carbide is non-uniformly dispersed after annealing, and a stable rough large ferrite grain texture cannot be obtained, so that softening cannot be achieved. Accordingly, it is important that the temperature from the end of first cooling to coiling be controlled by second cooling, and hence the temperature from the end of first cooling to coiling is held at 600° C. or less by the second cooling, more preferably at 580° C. or less, and even more preferably at 550° C. or less. In this case, the second cooling may be performed, for example, by laminar cooling.

(5) Coiling Temperature: 580° C. or Less

When coiling after cooling is performed at more than 580° C., lath-shaped ferrite grains forming bainite become slightly rough and large, the grain growth driving force in annealing becomes deficient, and a stable rough large ferrite grain texture cannot be obtained, so that softening cannot be achieved. On the other hand, when coiling after cooling is performed at 580° C. or less, lath-shaped ferrite grains become fine, and by using high grain boundary energy as a driving force in annealing, a stable rough large ferrite grain texture can be obtained. Accordingly, the coiling temperature is set to 580° C. or less, preferably 550° C. or less, and more preferably 530° C. or less. The lower limit of the coiling temperature is not particularly limited; however, since the shape of steel sheet is deteriorated as the temperature is decreased, the upper limit is preferably set to 200° C. or more.

(6) Pickling: Implementation

A hot-rolled steel sheet after coiling is processed by pickling prior to spheroidizing annealing in order to remove scale. The pickling may be performed in accordance with a general method.

(7) Spheroidizing Annealing: Box-Annealing at a Temperature in the Range of 680° C. to the $Ac_1$ Transformation Point After a hot-rolled steel sheet is processed by pickling, annealing is preformed in order to form sufficiently rough large ferrite grains and to spheroidize carbide. The spheroidizing annealing may be roughly represented by (1) a method in which heating is performed at a temperature just above $Ac_1$, followed by slow cooling; (2) a method in which a temperature just below $Ac_1$ is maintained for a long period of time; and (3) a method in which heating at a temperature just above $Ac_1$ and cooling just below $Ac_1$ are repeatedly performed. Among those described above, according to the present invention, by the method (2) described above, it is intended to simultaneously achieve the growth of ferrite grains and the spheroidization of carbide. Hence, since the spheroidizing annealing takes a long period of time, a box-annealing is employed. When the annealing temperature is less than 680° C., the formation of rough large ferrite grains and the spheroidization of carbide cannot be sufficiently performed, and since softening is not satisfactorily achieved, the workability is degraded. On the other hand, when the annealing temperature is more than the $Ac_1$ transformation temperature, an austenite texture is partly formed, and pearlite is again generated during cooling, so that also in this case, the workability is degraded. Accordingly, the annealing temperature of spheroidizing annealing is set in the range of 680° C. to the $Ac_1$ transformation point. In order to stably obtain a ferrite grain texture having an average ferrite grain diameter of more than 35 μm and a rough large ferrite ratio (grain diameter of 20 μm or more) of 80% or more, the annealing time is preferably set to 20 hours or more and is more preferably set to 40 hours or more. In addition, the $Ac_1$ transformation point (° C.) can be calculated by the following equation (2).

$$Ac_1=754.83-32.25C+23.32Si-17.76Mn+17.13Cr+4.51Mo \quad (2)$$

In the above equation, the chemical symbols each indicate the content (mass percent) thereof.

Accordingly, the ultra soft high carbon hot-rolled steel sheet of the present invention is obtained. Incidentally, for the component control of the high carbon steel according to the present invention, either a conversion furnace or an electric furnace may be used. High carbon steel having the controlled composition as described above is formed into a steel slab used as a raw steel material by ingot making-blooming rolling or continuous casting. This steel slab is processed by hot rolling, and in this step, a slab heating temperature is preferably set to 1,300° C. or less in order to prevent the degradation in surface conditions caused by scale generation. Alternatively, the continuous cast slab may be rolled by hot direct rolling while it is in an as-cast state or it is heated to suppress the decrease in temperature thereof. Furthermore, in hot rolling, the finish rolling may be performed by omitting the rough rolling. In order to maintain the finish temperature, a rolled material may be heated by heating means such as a bar heater during hot rolling. In addition, in order to facilitate the spheroidization or to decrease the hardness, after coiling, hot insulation may be performed for a coiled steel sheet by means such as a slow-cooling cover.

After annealing, temper rolling is performed whenever necessary. Since this temper annealing has no influence on the quenching properties, the conditions thereof are not particularly limited.

The reasons the high carbon hot-rolled steel sheet thus obtained has ultra soft properties and superior workability while the quenching properties are maintained are believed as follows. The hardness used as the index of the workability is considerably influenced by the average ferrite grain diameter, and when the ferrite grains have uniform grain diameter and are rough and large, ultra soft properties are obtained, so that the workability is improved. In addition, the quenching properties are remarkably influenced by the average carbide grain diameter. When carbide is rough and large, non-solid-solution carbide is liable to remain during solution treatment before quenching, and as a result, the quenched hardness is decreased. From the points described above, when the composition, the metal texture (the average ferrite grain diameter and the rough large ferrite ratio), and the carbide shape (average carbide grain diameter) are defined as described above and are all satisfied, a high carbon hot-rolled steel sheet having significantly superior softness can be obtained while the quenching properties are maintained.

EXAMPLE 1

Steel having the chemical components shown in Table 1 was processed by continuous casting, and slabs obtained thereby were each heated to 1,250° C., followed by hot rolling and annealing, in accordance with the conditions shown in Table 2, so that hot-rolled steel sheets each having a thickness of 3.0 mm were formed.

Next, after samples were obtained from the hot-rolled steel sheets obtained as described above, the average ferrite grain diameter, the rough large ferrite ratio, and the average carbide grain diameter of each sample were measured, and in addition, for the performance evaluation, a material hardness thereof was measured. The respective measurement methods and conditions are as described below.

<Average Ferrite Grain Diameter>

The measurement was performed using an optical microscopic texture of the cross-section of the sample by a section method described in JIS G 0552. In this measurement, the average grain diameter is defined as the average diameter obtained from at least 3,000 ferrite grains.

<Rough Large Ferrite Ratio>

After the cross-section of the sample in the thickness direction was polished and corroded, micro-texture observation was performed using an optical microscope, and from the area ratio of ferrite grains having a grain diameter of 10 μm (or 20 μm) or more to ferrite grains having a grain diameter of less than 10 μm (or less than 20 μm), the rough large ferrite ratio was obtained. However, as the rough large ferrite ratio, texture observation was performed using at least 10 viewing fields at a magnification of approximately 200 times, and the average value was employed.

<Average Carbide Grain Diameter>

After the cross-section of the sample in the thickness direction was polished and corroded, photographs of the micro-texture were taken by a scanning electron microscope, so that the measurement of the carbide grain diameters was performed. The average grain diameter is the average value obtained from the grain diameters of at least 500 carbides.

<Material Hardness>

After the cross-section of the sample was processed by buff finish, Vickers hardness (Hv) was measured at 5 points of the surface layer and the central position in the thickness direction by applying a load of 500 gf, and the average hardness was obtained.

The results obtained by the above measurements are shown in Table 3.

In table 3, steel sheet Nos. 1 to 15 are formed by manufacturing methods within the range of the present invention and are examples of the present invention each having a texture in which the average ferrite grain diameter is 20 μm or more, the rough large ferrite ratio (grain diameter of 10 μm or more) is 80% or more, and the average ferrite grain diameter is in the range of 0.10 to less than 2.0 μm. According to the examples of the present invention, it is understood that a high carbon hot-rolled steel sheet is obtained which has a low material hardness and a small difference in material hardness between the surface layer and the central portion in the thickness direction and which is stably softened.

On the other hand, steel sheet Nos. 16 to 23 are comparative examples formed by manufacturing methods which are outside the range of the present invention, and steel sheet No. 24 is a comparative example in which the steel composition is outside the range of the present invention. Steel sheet Nos. 16 to 24 each have an average ferrite grain diameter of less than 20 μm and a rough large ferrite ratio (grain diameter of 10 μm or more) of less than 80% and are outside the range of the present invention. As a result, in steel sheet Nos. 16 to 19, 21 and 23, the difference in material hardness between the surface layer and the central portion in the thickens direction is 15 points or more, the variation in material quality is large, and the workability is degraded. In addition, it is understood that since steel sheet Nos. 20, 22 and 24 have a very low rough large ferrite ratio (grain diameter of 10 μm or more), and the average ferrite grain diameter thereof is also outside the range of the present invention, the material hardness is high, and the workability and the mold life are degraded.

EXAMPLE 2

Steel having the chemical components shown in Table 4 was processed by continuous casting, and slabs obtained thereby were each heated to 1,250° C., followed by hot rolling and annealing, in accordance with the conditions shown in Table 5, so that hot-rolled steel sheets each having a thickness of 3.0 mm were formed.

Next, after a sample was obtained from the hot-rolled steel sheet obtained as described above, the average ferrite grain diameter, the rough large ferrite ratio, and the average carbide grain diameter of the sample were measured, and in addition, for the performance evaluation, the material hardness was measured. The respective measurement methods and conditions are the same as described in Example 1.

The results obtained by the above measurements are shown in Table 6.

In Table 6, according to steel sheet Nos. 25 to 34 which are examples of the present invention, it is understood that a high carbon hot-rolled steel sheet is obtained which has a low material hardness and a small difference in material hardness between the surface layer and the central portion in the thickness direction and which is stably softened. On the other hand, steel sheet No. 35 is a comparative example in which the steel composition is outside the range of the present invention. In steel sheet No. 35, the difference in material hardness between the surface layer and the central portion in the thickness direction is large, the variation in material quality is large, and the workability is degraded.

EXAMPLE 3

Steel having the chemical components shown in Table 1 was processed by continuous casting, and slabs obtained thereby were each heated to 1,250° C., followed by hot rolling and annealing, in accordance with the conditions shown in Table 7, so that hot-rolled steel sheets each having a thickness of 3.0 mm were formed. In this example, the rolling temperature in a pass prior to the final pass was always set to a temperature in the range of +20° C. to +30° C. higher than the rolling temperature in the final pass.

Next, after a sample was obtained from the hot-rolled steel sheet obtained as described above, the average ferrite grain diameter, the rough large ferrite ratio, and the average carbide grain diameter of the sample were measured, and in addition, for the performance evaluation, the material hardness was measured. The respective measurement methods and conditions are the same as described in Example 1.

The results obtained by the above measurements are shown in Table 8.

In table 8, steel sheet Nos. 36 to 50 are formed by manufacturing methods within the range of the present invention and are examples of the present invention which have a texture in which the average ferrite grain diameter is more than 35 μm, the rough large ferrite ratio (grain diameter of 20 μm or more) is 80% or more, and the average ferrite grain diameter is in the range of 0.10 to less than 2.0 μm. According to the examples of the present invention, it is understood that a high carbon hot-rolled steel sheet is obtained which has a lower material hardness and a small difference in material hardness between the surface layer and the central portion in the thickness direction and which is stably softened.

On the other hand, steel sheet Nos. 51 to 58 are comparative examples formed by manufacturing methods which are outside the range of the present invention, and steel sheet No. 59 is a comparative example in which the steel composition is outside the range of the present invention. Steel sheet Nos. 51 to 59 each have an average ferrite grain diameter of 35 μm or less and a rough large ferrite ratio (grain diameter of 20 μm or more) of less than 80% and are outside the range of the present invention. As a result, in steel sheet Nos. 51 to 54, 56 and 58, the difference (ΔHv) in material hardness between the surface layer and the central portion in the thickens direction is 20 points or more, the variation in material quality is large, and the workability is degraded. In addition, it is understood that in steel sheet Nos. 55, 57 and 59, since the rough large ferrite ratio is very low, and the average ferrite grain diameter is outside the range of the present invention, the material hardness is high, the workability and the mold life are degraded.

EXAMPLE 4

Steel having the chemical components shown in steel Nos. I to M of Table 4 was processed by continuous casting, and slabs obtained thereby were each heated to 1,250° C., followed by hot rolling and annealing, in accordance with the conditions shown in Table 9, so that hot-rolled steel sheets each having a thickness of 3.0 mm were formed. In this example, the rolling temperature in a pass prior to the final pass was always set to a temperature range of +20° C. to +30° C. higher than the rolling temperature in the final pass.

Next, after a sample was obtained from the hot-rolled steel sheet obtained as described above, the average ferrite grain diameter, the rough large ferrite ratio, and the average carbide grain diameter of the sample were measured, and in addition, for the performance evaluation, the material hardness was measured. The respective measurement methods and conditions are the same as described in Example 1.

The results obtained by the above measurements are shown in Table 10.

In table 10, steel sheet Nos. 60 to 73 are formed by manufacturing methods within the range of the present invention and are examples of the present invention which have a texture in which the average ferrite grain diameter is more than 35 μm, the rough large ferrite ratio (grain diameter of 20 μm or more) is 80% or more, and the average ferrite grain diameter is in the range of 0.10 to less than 2.0 μm. According to the examples of the present invention, it is understood that a high carbon hot-rolled steel sheet is obtained which has a lower material hardness and a small difference in material hardness between the surface layer and the central portion in the thickness direction and which is stably softened. However, since in steel sheet No. 65, the finish temperature is more than a preferable range of ($Ar_3$+100)° C., the average ferrite grain diameter is smaller than that of the other examples of the present invention, and the difference in material hardness between the surface layer and the central portion in the thickness direction becomes slightly larger.

On the other hand, steel sheet Nos. 74 to 80 are comparative examples formed by manufacturing methods which are outside the range of the present invention; in steel sheet Nos. 74 to 77, 79 and 80, the average ferrite grain diameter is 35 μm or less; and in steel sheet Nos. 74 to 80, the rough large ferrite ratios (grain diameter of 20 μm or more) are all less than 80%. Accordingly, in the comparative examples, since the material hardness is high, or the difference in hardness between the surface layer and the central portion in the thickness direction is 20 points or more, the variation in material quality is large, and the workability is degraded.

INDUSTRIAL APPLICABILITY

By using the ultra soft high carbon hot-rolled steel sheet according to the present invention, parts having a complicated shape, such as gears, can be easily formed by machining while a low load is applied, and hence the above hot-rolled steel sheet can be widely used in various applications such as tools and automobile parts.

TABLE 1

(MASS %)

| STEEL No. | C | Si | Mn | P | S | sol•Al | N | OTHERS | $Ar_3$ | $Ac_1$ |
|---|---|---|---|---|---|---|---|---|---|---|
| A | 0.22 | 0.19 | 0.71 | 0.011 | 0.008 | 0.031 | 0.0038 | tr | 816 | 743 |
| B | 0.33 | 0.20 | 0.68 | 0.009 | 0.008 | 0.029 | 0.0033 | tr | 769 | 740 |
| C | 0.35 | 0.21 | 0.74 | 0.011 | 0.008 | 0.031 | 0.0038 | Mo: 0.01 | 742 | 735 |
| D | 0.44 | 0.02 | 0.38 | 0.011 | 0.003 | 0.022 | 0.0051 | B: 0.002 | 732 | 732 |
| E | 0.48 | 0.32 | 0.82 | 0.015 | 0.006 | 0.038 | 0.0043 | Cr: 0.21 | 694 | 736 |
| F | 0.45 | 0.03 | 0.41 | 0.008 | 0.005 | 0.028 | 0.0040 | Ti: 0.02<br>Nb: 0.03 | 738 | 734 |
| G | 0.66 | 0.22 | 0.72 | 0.009 | 0.011 | 0.028 | 0.0031 | tr | 648 | 722 |
| H | 0.81 | 0.22 | 0.71 | 0.015 | 0.014 | 0.033 | 0.0041 | tr | 625 | 726 |

TABLE 2

| STEEL SHEET No. | STEEL No. | $Ar_3$ (° C.) | $Ac_1$ (° C.) | FINAL PASS REDUCTION RATIO (%) | FINAL PASS ROLLING TEMPERATURE (° C.) | FIRST COOLING START TIME (SEC) | FIRST COOLING RATE (° C./SEC) | FIRST COOLING STOP TEMPERATURE (° C.) |
|---|---|---|---|---|---|---|---|---|
| 1 | A | 816 | 743 | 12 | 850 | 1.0 | 220 | 530 |
| 2 | A | 816 | 743 | 21 | 830 | 0.8 | 200 | 490 |
| 3 | A | 816 | 743 | 20 | 830 | 0.8 | 320 | 520 |
| 4 | B | 769 | 740 | 14 | 820 | 0.4 | 180 | 530 |
| 5 | B | 769 | 740 | 20 | 800 | 0.6 | 200 | 510 |
| 6 | B | 769 | 740 | 18 | 810 | 0.8 | 300 | 510 |
| 7 | C | 742 | 735 | 16 | 810 | 1.0 | 180 | 530 |
| 8 | C | 742 | 735 | 21 | 790 | 0.4 | 200 | 500 |
| 9 | C | 742 | 735 | 20 | 800 | 0.8 | 340 | 520 |
| 10 | D | 732 | 732 | 13 | 780 | 0.4 | 280 | 500 |
| 11 | E | 694 | 736 | 11 | 730 | 1.2 | 320 | 580 |
| 12 | F | 738 | 734 | 11 | 720 | 1.1 | 300 | 470 |
| 13 | G | 648 | 722 | 15 | 760 | 0.6 | 160 | 530 |
| 14 | G | 648 | 722 | 20 | 770 | 0.5 | 220 | 510 |
| 15 | G | 648 | 722 | 20 | 770 | 0.8 | 320 | 520 |
| 16 | A | 816 | 743 | 12 | 780 | 0.8 | 180 | 540 |
| 17 | A | 816 | 743 | 15 | 830 | 0.9 | 80 | 520 |
| 18 | B | 769 | 740 | 16 | 830 | 2.2 | 220 | 500 |
| 19 | B | 769 | 740 | 20 | 810 | 0.9 | 200 | 620 |
| 20 | C | 742 | 735 | 18 | 820 | 0.4 | 180 | 530 |
| 21 | C | 742 | 735 | 21 | 800 | 1.1 | 160 | 590 |
| 22 | G | 648 | 722 | 8 | 770 | 0.9 | 200 | 520 |
| 23 | G | 648 | 722 | 18 | 750 | 1.6 | 220 | 600 |
| 24 | H | 625 | 726 | 14 | 750 | 0.8 | 240 | 530 |

| STEEL SHEET No. | SECOND COOLING HOLD TEMPERATURE (° C.) | COILING TEMPERATURE (° C.) | SPHEROIDIZING ANNEALING CONDITIONS | REMARKS |
|---|---|---|---|---|
| 1 | 520 | 500 | 700° C. × 20 hr | EXAMPLE |
| 2 | 500 | 480 | 720° C. × 30 hr | EXAMPLE |
| 3 | 510 | 500 | 720° C. × 30 hr | EXAMPLE |
| 4 | 530 | 510 | 690° C. × 20 hr | EXAMPLE |
| 5 | 520 | 500 | 720° C. × 20 hr | EXAMPLE |
| 6 | 510 | 500 | 720° C. × 20 hr | EXAMPLE |
| 7 | 520 | 500 | 700° C. × 20 hr | EXAMPLE |
| 8 | 510 | 490 | 720° C. × 30 hr | EXAMPLE |
| 9 | 520 | 520 | 720° C. × 20 hr | EXAMPLE |
| 10 | 510 | 490 | 710° C. × 30 hr | EXAMPLE |
| 11 | 570 | 570 | 680° C. × 30 hr | EXAMPLE |
| 12 | 500 | 480 | 710° C. × 20 hr | EXAMPLE |
| 13 | 520 | 500 | 680° C. × 20 hr | EXAMPLE |
| 14 | 520 | 490 | 720° C. × 20 hr | EXAMPLE |
| 15 | 500 | 500 | 720° C. × 30 hr | EXAMPLE |
| 16 | 530 | 510 | 690° C. × 20 hr | COMPARATIVE EXAMPLE |
| 17 | 510 | 490 | 700° C. × 30 hr | COMPARATIVE EXAMPLE |
| 18 | 490 | 500 | 720° C. × 20 hr | COMPARATIVE EXAMPLE |
| 19 | 550 | 520 | 700° C. × 20 hr | COMPARATIVE EXAMPLE |
| 20 | 530 | 510 | 660° C. × 30 hr | COMPARATIVE EXAMPLE |
| 21 | 600 | 590 | 680° C. × 30 hr | COMPARATIVE EXAMPLE |
| 22 | 510 | 490 | 720° C. × 30 hr | COMPARATIVE EXAMPLE |
| 23 | 610 | 570 | 680° C. × 30 hr | COMPARATIVE EXAMPLE |
| 24 | 520 | 500 | 720° C. × 20 hr | COMPARATIVE EXAMPLE |

TABLE 3

| STEEL SHEET No. | STEEL No. | AVERAGE FERRITE GRAIN DIAMETER (μm) | ROUGH LARGE FERRITE RATIO (GRAIN DIAMETER OF 10 μm OR MORE) (%) | AVERAGE CARBIDE GRAIN DIAMETER (μm) | MATERIAL HARDNESS (Hv) SURFACE LAYER | MATERIAL HARDNESS (Hv) CENTER IN THICKNESS DIRECTION | ΔHv | REMARKS |
|---|---|---|---|---|---|---|---|---|
| 1 | A | 60 | 89 | 0.9 | 103 | 105 | 2 | EXAMPLE |
| 2 | A | 68 | 95 | 0.9 | 103 | 103 | 0 | EXAMPLE |
| 3 | A | 69 | 96 | 1.0 | 101 | 100 | 1 | EXAMPLE |
| 4 | B | 45 | 88 | 1.1 | 109 | 111 | 2 | EXAMPLE |
| 5 | B | 36 | 92 | 1.2 | 114 | 115 | 1 | EXAMPLE |
| 6 | B | 38 | 94 | 1.1 | 111 | 110 | 1 | EXAMPLE |
| 7 | C | 38 | 88 | 1.1 | 112 | 114 | 2 | EXAMPLE |
| 8 | C | 48 | 90 | 1.0 | 108 | 109 | 1 | EXAMPLE |
| 9 | C | 47 | 90 | 1.1 | 110 | 110 | 0 | EXAMPLE |
| 10 | D | 34 | 90 | 1.0 | 120 | 122 | 2 | EXAMPLE |
| 11 | E | 29 | 86 | 0.9 | 125 | 123 | 2 | EXAMPLE |
| 12 | F | 33 | 92 | 1.2 | 125 | 122 | 3 | EXAMPLE |
| 13 | G | 21 | 85 | 1.3 | 133 | 136 | 3 | EXAMPLE |
| 14 | G | 23 | 87 | 1.5 | 133 | 134 | 1 | EXAMPLE |
| 15 | G | 25 | 93 | 1.5 | 130 | 129 | 1 | EXAMPLE |
| 16 | A | 17 | 70 | 0.8 | 124 | 143 | 19 | COMPARATIVE EXAMPLE |
| 17 | A | 16 | 63 | 0.9 | 140 | 119 | 21 | COMPARATIVE EXAMPLE |
| 18 | B | 9 | 38 | 1.2 | 128 | 143 | 15 | COMPARATIVE EXAMPLE |
| 19 | B | 11 | 50 | 1.1 | 141 | 125 | 16 | COMPARATIVE EXAMPLE |
| 20 | C | 7 | 7 | 0.4 | 151 | 151 | 0 | COMPARATIVE EXAMPLE |
| 21 | C | 17 | 66 | 0.9 | 138 | 121 | 17 | COMPARATIVE EXAMPLE |
| 22 | G | 7 | 6 | 1.4 | 160 | 162 | 2 | COMPARATIVE EXAMPLE |
| 23 | G | 10 | 58 | 1.3 | 155 | 137 | 18 | COMPARATIVE EXAMPLE |
| 24 | H | 5 | 4 | 1.7 | 173 | 174 | 1 | COMPARATIVE EXAMPLE |

TABLE 4

(MASS %)

| STEEL No. | C | Si | Mn | P | S | sol•Al | N | B | Cr | OTHERS | $Ar_3$ | $Ac_1$ | REMARKS |
|---|---|---|---|---|---|---|---|---|---|---|---|---|---|
| I | 0.28 | 0.04 | 0.48 | 0.008 | 0.002 | 0.04 | 0.0041 | 0.0022 | 0.21 | tr | 782 | 742 | EXAMPLE |
| J | 0.22 | 0.21 | 0.80 | 0.022 | 0.007 | 0.02 | 0.0037 | 0.0031 | 0.25 | Ti: 0.03 Nb: 0.02 | 774 | 743 | EXAMPLE |
| K | 0.36 | 0.02 | 0.45 | 0.014 | 0.001 | 0.03 | 0.0043 | 0.0026 | 0.18 | tr | 760 | 739 | EXAMPLE |
| L | 0.51 | 0.18 | 0.74 | 0.009 | 0.005 | 0.04 | 0.0038 | 0.0028 | 0.22 | Mo: 0.01 | 689 | 733 | EXAMPLE |
| M | 0.66 | 0.24 | 0.68 | 0.017 | 0.003 | 0.03 | 0.0035 | 0.0019 | 0.15 | tr | 649 | 730 | EXAMPLE |
| N | 0.14 | 0.23 | 0.74 | 0.013 | 0.006 | 0.02 | 0.0038 | 0.0023 | 0.21 | tr | 804 | 746 | COMPARATIVE EXAMPLE |

TABLE 5

| STEEL SHEET No. | STEEL No. | $Ar_3$ (° C.) | $Ac_1$ (° C.) | FINAL PASS REDUCTION RATIO (%) | FINAL PASS FINISH TEMPERATURE (° C.) | FIRST COOLING START TIME (SEC) | FIRST COOLING RATE (° C./SEC) | FIRST COOLING STOP TEMPERATURE (° C.) |
|---|---|---|---|---|---|---|---|---|
| 25 | I | 782 | 742 | 18 | 830 | 0.7 | 180 | 580 |
| 26 | I | 782 | 742 | 20 | 840 | 0.4 | 320 | 540 |
| 27 | J | 774 | 743 | 18 | 880 | 0.7 | 180 | 580 |
| 28 | J | 774 | 743 | 21 | 870 | 0.9 | 280 | 530 |
| 29 | K | 760 | 739 | 18 | 800 | 0.7 | 180 | 580 |
| 30 | K | 760 | 739 | 19 | 810 | 1.0 | 240 | 520 |
| 31 | L | 689 | 733 | 15 | 780 | 1.0 | 180 | 600 |
| 32 | L | 689 | 733 | 13 | 770 | 1.2 | 300 | 550 |
| 33 | M | 649 | 730 | 15 | 730 | 1.0 | 180 | 600 |
| 34 | M | 649 | 730 | 11 | 720 | 0.8 | 320 | 520 |
| 35 | N | 804 | 746 | 18 | 890 | 0.7 | 180 | 580 |

TABLE 5-continued

| STEEL SHEET No. | SECOND COOLING HOLD TEMPERATURE (° C.) | COILING TEMPERATURE (° C.) | SPHEROIDIZING ANNEALING CONDITIONS | REMARKS |
|---|---|---|---|---|
| 25 | 560 | 530 | 700° C. × 40 hr | EXAMPLE |
| 26 | 550 | 520 | 710° C. × 30 hr | EXAMPLE |
| 27 | 560 | 530 | 680° C. × 20 hr | EXAMPLE |
| 28 | 520 | 510 | 700° C. × 20 hr | EXAMPLE |
| 29 | 560 | 530 | 720° C. × 20 hr | EXAMPLE |
| 30 | 520 | 520 | 720° C. × 30 hr | EXAMPLE |
| 31 | 580 | 550 | 720° C. × 40 hr | EXAMPLE |
| 32 | 540 | 540 | 690° C. × 30 hr | EXAMPLE |
| 33 | 580 | 550 | 720° C. × 60 hr | EXAMPLE |
| 34 | 500 | 500 | 700° C. × 30 hr | EXAMPLE |
| 35 | 560 | 530 | 680° C. × 30 hr | COMPARATIVE EXAMPLE |

TABLE 6

| STEEL SHEET No. | STEEL No. | AVERAGE FERRITE GRAIN DIAMETER (μm) | ROUGH LARGE FERRITE RATIO (GRAIN DIAMETER OF 10 μm OR MORE) (%) | AVERAGE CARBIDE GRAIN DIAMETER (μm) | MATERIAL HARDNESS (Hv) SURFACE LAYER | CENTER IN THICKNESS DIRECTION | ΔHv | REMARKS |
|---|---|---|---|---|---|---|---|---|
| 25 | I | 72 | 93 | 0.9 | 93 | 98 | 5 | EXAMPLE |
| 26 | I | 74 | 95 | 0.9 | 94 | 95 | 1 | EXAMPLE |
| 27 | J | 86 | 89 | 1.5 | 91 | 94 | 3 | EXAMPLE |
| 28 | J | 90 | 94 | 1.7 | 90 | 91 | 1 | EXAMPLE |
| 29 | K | 52 | 85 | 1.1 | 104 | 108 | 4 | EXAMPLE |
| 30 | K | 53 | 88 | 1.1 | 103 | 106 | 3 | EXAMPLE |
| 31 | L | 45 | 89 | 1.3 | 114 | 115 | 1 | EXAMPLE |
| 32 | L | 42 | 86 | 1.2 | 117 | 117 | 0 | EXAMPLE |
| 33 | M | 41 | 91 | 1.0 | 121 | 127 | 6 | EXAMPLE |
| 34 | M | 38 | 88 | 0.9 | 125 | 128 | 3 | EXAMPLE |
| 35 | N | 61 | 66 | 0.9 | 91 | 121 | 30 | COMPARATIVE EXAMPLE |

TABLE 7

| STEEL SHEET No. | STEEL No. | $Ar_3$ (° C.) | $Ac_1$ (° C.) | PASS PRIOR TO FINAL PASS REDUCTION RATIO (%) | FINAL PASS REDUCTION RATIO (%) | FINAL PASS ROLLING TEMPERATURE (° C.) | FIRST COOLING START TIME (SEC) | FIRST COOLING RATE (° C./SEC) |
|---|---|---|---|---|---|---|---|---|
| 36 | A | 816 | 743 | 36 | 12 | 890 | 0.9 | 220 |
| 37 | A | 816 | 743 | 36 | 20 | 840 | 0.7 | 200 |
| 38 | A | 816 | 743 | 38 | 21 | 830 | 0.8 | 320 |
| 39 | B | 769 | 740 | 32 | 11 | 850 | 0.6 | 200 |
| 40 | B | 769 | 740 | 32 | 16 | 810 | 0.4 | 180 |
| 41 | B | 769 | 740 | 34 | 18 | 810 | 0.8 | 340 |
| 42 | C | 742 | 735 | 32 | 10 | 840 | 0.7 | 180 |
| 43 | C | 742 | 735 | 32 | 16 | 810 | 0.5 | 160 |
| 44 | C | 742 | 735 | 33 | 20 | 800 | 1.0 | 300 |
| 45 | D | 732 | 732 | 32 | 18 | 780 | 0.5 | 280 |
| 46 | E | 694 | 736 | 34 | 20 | 730 | 0.9 | 320 |
| 47 | F | 738 | 734 | 36 | 16 | 740 | 0.6 | 300 |
| 48 | G | 648 | 722 | 30 | 11 | 780 | 0.6 | 180 |
| 49 | G | 648 | 722 | 30 | 15 | 740 | 0.4 | 180 |
| 50 | G | 648 | 722 | 34 | 20 | 740 | 0.8 | 320 |
| 51 | A | 816 | 743 | 36 | 11 | 780 | 1.0 | 180 |
| 52 | A | 816 | 743 | 36 | 18 | 850 | 0.8 | 70 |
| 53 | B | 769 | 740 | 32 | 12 | 830 | 2.1 | 180 |
| 54 | B | 769 | 740 | 32 | 17 | 810 | 0.8 | 160 |
| 55 | C | 742 | 735 | 32 | 12 | 810 | 0.7 | 160 |
| 56 | C | 742 | 735 | 32 | 19 | 790 | 0.5 | 180 |
| 57 | G | 648 | 722 | 30 | 8 | 790 | 0.9 | 200 |
| 58 | G | 648 | 722 | 30 | 15 | 760 | 0.7 | 200 |
| 59 | H | 625 | 726 | 28 | 12 | 750 | 0.7 | 200 |

TABLE 7-continued

| STEEL SHEET No. | FIRST COOLING STOP TEMPERATURE (° C.) | SECOND COOLING HOLD TEMPERATURE (° C.) | COILING TEMPERATURE (° C.) | SPHEROIDIZING ANNEALING CONDITIONS | REMARKS |
|---|---|---|---|---|---|
| 36 | 530 | 520 | 500 | 700° C. × 30 hr | EXAMPLE |
| 37 | 500 | 510 | 490 | 720° C. × 50 hr | EXAMPLE |
| 38 | 520 | 520 | 500 | 720° C. × 60 hr | EXAMPLE |
| 39 | 520 | 520 | 500 | 700° C. × 40 hr | EXAMPLE |
| 40 | 490 | 500 | 480 | 720° C. × 60 hr | EXAMPLE |
| 41 | 500 | 520 | 500 | 720° C. × 60 hr | EXAMPLE |
| 42 | 520 | 510 | 490 | 700° C. × 30 hr | EXAMPLE |
| 43 | 500 | 500 | 480 | 720° C. × 60 hr | EXAMPLE |
| 44 | 520 | 500 | 490 | 720° C. × 60 hr | EXAMPLE |
| 45 | 500 | 520 | 500 | 700° C. × 50 hr | EXAMPLE |
| 46 | 540 | 550 | 540 | 710° C. × 50 hr | EXAMPLE |
| 47 | 470 | 480 | 480 | 720° C. × 60 hr | EXAMPLE |
| 48 | 520 | 530 | 500 | 700° C. × 30 hr | EXAMPLE |
| 49 | 480 | 500 | 480 | 720° C. × 50 hr | EXAMPLE |
| 50 | 520 | 500 | 500 | 720° C. × 60 hr | EXAMPLE |
| 51 | 540 | 530 | 510 | 690° C. × 30 hr | COMPARATIVE EXAMPLE |
| 52 | 520 | 530 | 510 | 700° C. × 40 hr | COMPARATIVE EXAMPLE |
| 53 | 520 | 520 | 500 | 720° C. × 40 hr | COMPARATIVE EXAMPLE |
| 54 | 620 | 550 | 530 | 680° C. × 50 hr | COMPARATIVE EXAMPLE |
| 55 | 530 | 520 | 500 | 640° C. × 30 hr | COMPARATIVE EXAMPLE |
| 56 | 580 | 600 | 590 | 720° C. × 50 hr | COMPARATIVE EXAMPLE |
| 57 | 550 | 530 | 510 | 700° C. × 40 hr | COMPARATIVE EXAMPLE |
| 58 | 600 | 610 | 580 | 720° C. × 60 hr | COMPARATIVE EXAMPLE |
| 59 | 530 | 530 | 510 | 700° C. × 40 hr | COMPARATIVE EXAMPLE |

TABLE 8

| STEEL SHEET No. | STEEL No. | AVERAGE FERRITE GRAIN DIAMETER (μm) | ROUGH LARGE FERRITE RATIO (GRAIN DIAMETER OF 20 μm OR MORE) (%) | AVERAGE CARBIDE GRAIN DIAMETER (μm) | MATERIAL HARDNESS (Hv) SURFACE LAYER | CENTER IN THICKNESS DIRECTION | ΔHv | REMARKS |
|---|---|---|---|---|---|---|---|---|
| 36 | A | 80 | 89 | 0.9 | 100 | 104 | 4 | EXAMPLE |
| 37 | A | 85 | 96 | 0.9 | 98 | 99 | 1 | EXAMPLE |
| 38 | A | 88 | 97 | 1.0 | 96 | 98 | 2 | EXAMPLE |
| 39 | B | 59 | 88 | 1.2 | 103 | 106 | 3 | EXAMPLE |
| 40 | B | 65 | 96 | 1.3 | 102 | 102 | 0 | EXAMPLE |
| 41 | B | 66 | 96 | 1.3 | 101 | 101 | 0 | EXAMPLE |
| 42 | C | 55 | 86 | 1.2 | 109 | 113 | 4 | EXAMPLE |
| 43 | C | 61 | 95 | 1.1 | 105 | 105 | 0 | EXAMPLE |
| 44 | C | 62 | 96 | 1.1 | 103 | 104 | 1 | EXAMPLE |
| 45 | D | 48 | 95 | 1.3 | 114 | 112 | 2 | EXAMPLE |
| 46 | E | 47 | 95 | 1.4 | 111 | 112 | 1 | EXAMPLE |
| 47 | F | 48 | 96 | 1.4 | 110 | 111 | 1 | EXAMPLE |
| 48 | G | 41 | 86 | 1.5 | 121 | 124 | 3 | EXAMPLE |
| 49 | G | 46 | 92 | 1.7 | 119 | 120 | 1 | EXAMPLE |
| 50 | G | 48 | 95 | 1.7 | 118 | 118 | 0 | EXAMPLE |
| 51 | A | 16 | 68 | 1.0 | 115 | 140 | 25 | COMPARATIVE EXAMPLE |
| 52 | A | 18 | 63 | 1.1 | 136 | 111 | 25 | COMPARATIVE EXAMPLE |
| 53 | B | 16 | 50 | 1.3 | 116 | 137 | 21 | COMPARATIVE EXAMPLE |
| 54 | B | 13 | 51 | 1.1 | 143 | 120 | 23 | COMPARATIVE EXAMPLE |
| 55 | C | 7 | 7 | 0.5 | 148 | 151 | 3 | COMPARATIVE EXAMPLE |
| 56 | C | 14 | 58 | 0.9 | 141 | 118 | 23 | COMPARATIVE EXAMPLE |

TABLE 8-continued

| STEEL SHEET No. | STEEL No. | AVERAGE FERRITE GRAIN DIAMETER (μm) | ROUGH LARGE FERRITE RATIO (GRAIN DIAMETER OF 20 μm OR MORE) (%) | AVERAGE CARBIDE GRAIN DIAMETER (μm) | MATERIAL HARDNESS (Hv) SURFACE LAYER | CENTER IN THICKNESS DIRECTION | ΔHv | REMARKS |
|---|---|---|---|---|---|---|---|---|
| 57 | G | 6 | 6 | 1.3 | 160 | 159 | 1 | COMPARATIVE EXAMPLE |
| 58 | G | 14 | 58 | 1.4 | 152 | 128 | 24 | COMPARATIVE EXAMPLE |
| 59 | H | 4 | 4 | 1.6 | 172 | 173 | 1 | COMPARATIVE EXAMPLE |

TABLE 9

| STEEL SHEET No. | STEEL No. | $Ar_3$ (° C.) | $Ac_1$ (° C.) | PASS PRIOR TO FINAL PASS REDUCTION RATIO (%) | FINAL PASS REDUCTION RATIO (%) | FINAL PASS ROLLING TEMPERATURE (° C.) | FIRST COOLING START TIME (SEC) | FIRST COOLING RATE (° C./SEC) |
|---|---|---|---|---|---|---|---|---|
| 60 | I | 782 | 742 | 34 | 12 | 830 | 0.7 | 180 |
| 61 | I | 782 | 742 | 34 | 16 | 820 | 0.7 | 160 |
| 62 | I | 782 | 742 | 36 | 12 | 830 | 0.5 | 180 |
| 63 | I | 782 | 742 | 36 | 18 | 820 | 0.5 | 200 |
| 64 | I | 782 | 742 | 38 | 20 | 820 | 0.4 | 320 |
| 65 | I | 782 | 742 | 30 | 12 | 920 | 0.5 | 180 |
| 66 | J | 774 | 743 | 37 | 19 | 800 | 0.7 | 300 |
| 67 | K | 760 | 739 | 32 | 11 | 820 | 0.8 | 170 |
| 68 | K | 760 | 739 | 32 | 17 | 820 | 0.8 | 140 |
| 69 | K | 760 | 739 | 30 | 11 | 800 | 0.4 | 190 |
| 70 | K | 760 | 739 | 30 | 20 | 800 | 0.4 | 220 |
| 71 | K | 760 | 739 | 34 | 20 | 810 | 0.7 | 320 |
| 72 | L | 689 | 733 | 36 | 20 | 770 | 0.8 | 300 |
| 73 | M | 649 | 730 | 38 | 18 | 740 | 0.7 | 340 |
| 74 | I | 782 | 742 | 32 | 6 | 830 | 0.7 | 180 |
| 75 | I | 782 | 742 | 32 | 12 | 750 | 0.7 | 160 |
| 76 | I | 782 | 742 | 30 | 12 | 830 | 0.5 | 60 |
| 77 | K | 760 | 739 | 34 | 11 | 820 | 2.4 | 170 |
| 78 | K | 760 | 739 | 34 | 11 | 820 | 0.8 | 170 |
| 79 | K | 760 | 739 | 36 | 13 | 800 | 0.4 | 190 |
| 80 | K | 760 | 739 | 36 | 13 | 800 | 0.4 | 190 |

| STEEL SHEET No. | FIRST COOLING STOP TEMPERATURE (° C.) | SECOND COOLING HOLD TEMPERATURE (° C.) | COILING TEMPERATURE (° C.) | SPHEROIDIZING ANNEALING CONDITIONS | REMARKS |
|---|---|---|---|---|---|
| 60 | 580 | 560 | 530 | 700° C. × 40 hr | EXAMPLE |
| 61 | 580 | 560 | 530 | 680° C. × 40 hr | EXAMPLE |
| 62 | 530 | 510 | 480 | 720° C. × 40 hr | EXAMPLE |
| 63 | 550 | 530 | 510 | 700° C. × 20 hr | EXAMPLE |
| 64 | 540 | 540 | 530 | 720° C. × 40 hr | EXAMPLE |
| 65 | 530 | 510 | 480 | 720° C. × 40 hr | EXAMPLE |
| 66 | 530 | 530 | 500 | 720° C. × 40 hr | EXAMPLE |
| 67 | 550 | 540 | 520 | 720° C. × 20 hr | EXAMPLE |
| 68 | 550 | 500 | 480 | 700° C. × 40 hr | EXAMPLE |
| 69 | 500 | 480 | 450 | 680° C. × 60 hr | EXAMPLE |
| 70 | 500 | 460 | 420 | 720° C. × 40 hr | EXAMPLE |
| 71 | 520 | 500 | 480 | 720° C. × 40 hr | EXAMPLE |
| 72 | 520 | 500 | 480 | 720° C. × 40 hr | EXAMPLE |
| 73 | 510 | 500 | 500 | 720° C. × 30 hr | EXAMPLE |
| 74 | 580 | 560 | 530 | 700° C. × 40 hr | COMPARATIVE EXAMPLE |
| 75 | 580 | 560 | 520 | 680° C. × 40 hr | COMPARATIVE EXAMPLE |
| 76 | 550 | 530 | 510 | 700° C. × 20 hr | COMPARATIVE EXAMPLE |
| 77 | 550 | 540 | 520 | 720° C. × 20 hr | COMPARATIVE EXAMPLE |
| 78 | 620 | 610 | 590 | 700° C. × 40 hr | COMPARATIVE EXAMPLE |

TABLE 9-continued

| | | | | | |
|---|---|---|---|---|---|
| 79 | 500 | 480 | 450 | 650° C. × 40 hr | COMPARATIVE EXAMPLE |
| 80 | 500 | 460 | 420 | 750° C. × 40 hr | COMPARATIVE EXAMPLE |

TABLE 10

| STEEL SHEET No. | STEEL No. | AVERAGE FERRITE GRAIN DIAMETER (μm) | ROUGH LARGE FERRITE RATIO (GRAIN DIAMETER OF 20 μm OR MORE) (%) | AVERAGE CARBIDE GRAIN DIAMETER (μm) | MATERIAL HARDNESS (Hv) SURFACE LAYER | CENTER IN THICKNESS DIRECTION | ΔHv | REMARKS |
|---|---|---|---|---|---|---|---|---|
| 60 | I | 68 | 93 | 0.9 | 98 | 103 | 5 | EXAMPLE |
| 61 | I | 57 | 88 | 0.7 | 104 | 108 | 4 | EXAMPLE |
| 62 | I | 72 | 90 | 1.2 | 95 | 99 | 4 | EXAMPLE |
| 63 | I | 83 | 96 | 1.0 | 92 | 94 | 2 | EXAMPLE |
| 64 | I | 85 | 96 | 1.2 | 90 | 92 | 2 | EXAMPLE |
| 65 | I | 28 | 81 | 0.8 | 112 | 119 | 7 | EXAMPLE |
| 66 | J | 92 | 97 | 1.7 | 88 | 88 | 0 | EXAMPLE |
| 67 | K | 42 | 85 | 1.1 | 111 | 114 | 3 | EXAMPLE |
| 68 | K | 56 | 89 | 0.8 | 108 | 113 | 5 | EXAMPLE |
| 69 | K | 51 | 83 | 1.0 | 113 | 116 | 3 | EXAMPLE |
| 70 | K | 63 | 95 | 1.3 | 112 | 114 | 2 | EXAMPLE |
| 71 | K | 68 | 96 | 1.3 | 102 | 106 | 4 | EXAMPLE |
| 72 | L | 55 | 93 | 1.4 | 110 | 112 | 2 | EXAMPLE |
| 73 | M | 51 | 95 | 1.4 | 120 | 124 | 4 | EXAMPLE |
| 74 | I | 5 | 3 | 1.1 | 154 | 162 | 8 | COMPARATIVE EXAMPLE |
| 75 | I | 18 | 46 | 1.7 | 122 | 148 | 26 | COMPARATIVE EXAMPLE |
| 76 | I | 16 | 25 | 1.6 | 136 | 159 | 23 | COMPARATIVE EXAMPLE |
| 77 | K | 6 | 2 | 1.0 | 166 | 164 | 2 | COMPARATIVE EXAMPLE |
| 78 | K | 38 | 31 | 1.3 | 130 | 151 | 21 | COMPARATIVE EXAMPLE |
| 79 | K | 3 | 0 | 0.7 | 170 | 171 | 1 | COMPARATIVE EXAMPLE |
| 80 | K | NOT MEASURABLE | NOT MEASURABLE | NOT MEASURABLE | 142 | 164 | 22 | COMPARATIVE EXAMPLE |

The invention claimed is:

1. A method for manufacturing an ultra soft, high carbon hot-rolled steel sheet having a volume ratio of ferrite grains having a grain diameter of 10 μm or more which is 80% or more, comprising the steps of: performing rough rolling of a steel comprising on a mass percent basis: 0.2% to 0.7% of C, 0.01% to 1.0% of Si, 0.1% to 1.0% of Mn, 0.03% or less of P, 0.035% or less of S, 0.08% or less of Al, 0.01% or less of N, and the balance being Fe and incidental impurities, then performing a finish rolling at a reduction ratio of 20% or more and at a finish temperature of $(Ar_3-20)$° C. or more in a final pass, then performing a first cooling within 2 seconds after the finish rolling to a cooling stop temperature of 600° C. or less at a cooling rate of more than 120° C./sec, then performing a second cooling so that the steel is held at 600° C. or less, then performing coiling at 580° C. or less, followed by pickling, and then performing a spheroidizing annealing at a temperature in the range of 680° C. to less than the $Ac_1$ transformation point by a box-annealing process, wherein in the texture of the ultra soft, high carbon hot-rolled steel sheet, an average ferrite grain diameter is 20 μm or more and an average carbide grain diameter is in the range of 0.10 to less than 2.0 μm.

2. A method for manufacturing an ultra soft, high carbon hot-rolled steel sheet having a volume ratio of ferrite grains having a grain diameter of 10 μm or more which is 80% or more, comprising the steps of: performing rough rolling of a steel comprising on a mass percent basis:

0.2% to 0.7% of C, 0.01% to 1.0% of Si, 0.1% to 1.0% of Mn, 0.03% or less of P, 0.035% or less of S, 0.08% or less of Al, 0.01% or less of N, and the balance being Fe and incidental impurities, then performing a finish rolling at a reduction ratio of 20% or more and at a finish temperature of $(Ar_3-20)$° C. or more in a final pass, then performing a first cooling within 2 seconds after the finish rolling to a cooling stop temperature of 550° C. or less at a cooling rate of more than 120° C. /sec, then performing a second cooling so that the steel is held at 550° C. or less, then performing coiling at 530° C. or less, followed by pickling, and then performing a spheroidizing annealing at a temperature in the range of 680° C. to less than the $Ac_1$ transformation point by a box-annealing process, wherein in the texture of the ultra soft, high carbon hot-rolled steel sheet, an average ferrite grain diameter is 20 μm or more and an average carbide grain diameter is in the range of 0.10 to less than 2.0 μm.

3. A method for manufacturing an ultra soft high carbon hot-rolled steel sheet having a volume ratio of ferrite grains having a grain diameter of 20 μm or more which is 80% or more, comprising the steps of:

performing rough rolling of a steel comprising on a mass percent basis: 0.2% to 0.7% of C, 0.01% to 1.0% of Si, 0.1% to 1.0% of Mn, 0.03% or less of P, 0.035% or less of S, 0.08% or less of Al, 0.01% or less of N, and the balance being Fe and incidental impurities, then performing a finish rolling in which the final two passes are each performed at a reduction ratio of 20% or more in a temperature range of $(Ar_3-20)°$ C. to $(Ar_3+150)°$ C., then performing a first cooling within 2 seconds after the finish rolling to a cooling stop temperature of 600° C. or less at a cooling rate of more than 120° C. /sec, then performing a second cooling so that the steel is held at 600° C. or less, then performing coiling at 580° C. or less, followed by pickling, and then performing a spheroidizing annealing at a temperature in the range of 680° C. to less than the $Ac_1$ transformation point for a soaking time of 20 hours or more by a box-annealing process, wherein in the texture of the ultra soft, high carbon hot-rolled steel sheet, an average ferrite grain diameter is more than 35 μm and an average carbide grain diameter is in the range of 0.10 to less than 2.0 μm.

4. A method for manufacturing an ultra soft high carbon hot-rolled steel sheet having a volume ratio of ferrite grains having a grain diameter of 20 μm or more which is 80% or more, comprising the steps of: performing rough rolling of a steel comprising on a mass percent basis: 0.2% to 0.7% of C, 0.01% to 1.0% of Si, 0.1% to 1.0% of Mn, 0.03% or less of P, 0.035% or less of S, 0.08% or less of Al, 0.01% or less of N, and the balance being Fe and incidental impurities, then performing a finish rolling in which the final two passes are each performed at a reduction ratio of 20% or more in a temperature range of $(Ar_3-20)°$ C. to $(Ar_3+100)°$ C., then performing a first cooling within 2 seconds after the finish rolling to a cooling stop temperature of 550° C. or less at a cooling rate of more than 120° C. /sec, then performing a second cooling so that the steel is held at 550° C. or less, then performing coiling at 530° C. or less, followed by pickling, and then performing a spheroidizing annealing at a temperature in the range of 680° C. to less than the $Ac_1$ transformation point for a soaking time of 20 hours or more by a box-annealing process, wherein in the texture of the hot-rolled steel sheet, an average ferrite grain diameter is more than 35 μm and an average carbide grain diameter is in the range of 0.10 to less than 2.0 μm.

* * * * *